US006265345B1

(12) United States Patent
Yoshida et al.

(10) Patent No.: US 6,265,345 B1
(45) Date of Patent: Jul. 24, 2001

(54) THERMAL TRANSFER SHEET

(75) Inventors: Kazuya Yoshida, Higashi Matuyama; Takeshi Takada, Tokyo, both of (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 09/342,832

(22) Filed: Jun. 28, 1999

(30) Foreign Application Priority Data

Jun. 29, 1998 (JP) ..... 10-182159

(51) Int. Cl.[7] ..... B41M 5/035; B41M 5/38
(52) U.S. Cl. ..... 503/227; 428/913
(58) Field of Search ..... 8/471; 428/195, 428/913, 914; 503/227

(56) References Cited

U.S. PATENT DOCUMENTS 4,990,484 * 2/1991 Nakamura ..... 503/227

* cited by examiner

*Primary Examiner*—Bruce H. Hess
(74) *Attorney, Agent, or Firm*—Morgan, Lewis & Bockius LLP

(57) ABSTRACT

A thermal transfer sheet is provided for use in a sublimation thermal transfer recording method. A thermal transfer sheet of the present invention includes a specific combination of dyes and being capable of producing a picture image having an improved light-resistant colorfastness.

23 Claims, No Drawings

THERMAL TRANSFER SHEET

This application claims the benefit of Japanese Application No. 10-182159, filed in Japan on June 29, 1998, which is hereby incorporated by reference.

BACKGROUND OF THE INVENTION

1. Field of the Invention

The present invention relates to a thermal transfer sheet for use in sublimation thermal transfer recording, and more particularly, to a thermal transfer sheet that yields a picture image having an improved light-resistant colorfastness.

2. Discussion of the Related Art

A sublimation thermal transfer recording method has been known in the art as a simple method for producing full-color picture images. In the sublimation thermal transfer recording method, a sublimating dye of yellow, cyan, or magenta and an appropriate binder resin are coated on one face of a base film, such as a polyester film, to form a dye layer with the corresponding hue. The thus produced three thermal transfer sheets bearing respective colors are used to produce full color images on an image-receiving sheet. A chromophil thermal-transfer image-receiving sheet is alternately overlaid with the thermal transfer sheets bearing the respective three colors (and black, if necessary), and each dye on the respective thermal transfer sheet is sublimated and transferred onto a dye-receiving layer of the image-receiving sheet by a thermal head printer, thereby enabling regeneration of a full color picture image from an original.

Although the dyes for use in the thermal transfer sheets for respective colors should be selected from yellow, magenta, and cyan dyes having ideal huse—the dyes used in other printing methods such as offset printing, for example—in order to precisely reproduce the colors in the original picture, it is practically difficult to generate an ideal hue using merely one kind of dye. Conventionally, a plurality of dyes are blended for each color to produce acceptable hues.

Among the three thermal transfer sheets bearing respective colors, the cyan thermal transfer sheet is particularly difficult to regenerate an ideal cyan color if only one kind of cyan dye is used. A nearly ideal cyan is obtained by blending two or more kinds of cyan dyes. However, when the picture is formed by using such a conventional cyan thermal transfer sheet, the quality of the resulting full-color picture image degrades as time elapses; i.e., a light resistance is not sufficient. It is considered that this degradation occurs because of photo decomposition or photodegradation of the constituent dyes, which in turn occurs because the cyan dyes transferred from such a cyan thermal transfer sheet to the dye receiving layer exert catalytic effects on each other in the dye receiving layer under external light irradiation. When the cyan color fades or changes in the full-color picture image, the overall quality of the full-color picture image suffers considerably.

SUMMARY OF THE INVENTION

Accordingly, the present invention is directed to a thermal transfer sheet that substantially obviates the problems due to limitations and disadvantages of the related art.

An object of the present invention is to provide a thermal transfer sheet capable of forming a picture image with an excellent light resistance without causing catalytic color changes or fading.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof.

To achieve these and other advantages and in accordance with the purpose of the present invention, as embodied and broadly described, the present invention provides a thermal transfer sheet comprising a base sheet and a dye layer coated on the base sheet, wherein the dye layer comprises a binder resin; at least one dye of the following formula (1); and at least one dye of the following formula (2):

(1)

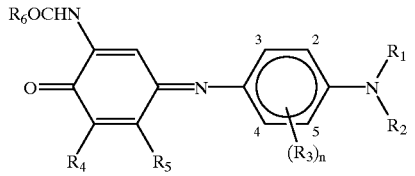

(2)

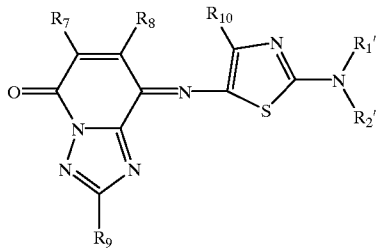

wherein $R_1$, $R_2$, $R_1'$ and $R_2'$ in the formulae independently represent a substituted or non-substituted alkyl group, a substituted or non-substituted cycloalkyl group, a substituted or non-substituted aralkyl group, or a substituted or non-substituted aryl group; $R_3$ represents a hydrogen atom, a halogen atom, a cyano group, a hydroxyl group, a substituted or non-substituted alkyl group, a substituted or non-substituted alkoxy group, a substituted or non-substituted cycloalkyl group, a substituted or non-substituted aralkyl group, a substituted or non-substituted aryl group, a substituted or non-substituted acyl group, a substituted or non-substituted acylamino group, or a substituted or non-substituted sulfonylamino group; $R_4$ represents a hydrogen atom or a halogen atom; $R_5$ represents a hydrogen atom or a substituted or non-substituted alkyl group; $R_6$ represents a substituted or non-substituted alkyl group, a substituted or non-substituted cycloalkyl group, a substituted or non-substituted aralkyl group, a substituted or non-substituted aryl group, or a substituted or non-substituted alkoxy group; and $R_7$ and $R_8$ each represent a substituted or non-substituted alkyl group, a substituted or non-substituted cycloalkyl group, a substituted or non-substituted alkoxycarbonyl group, a substituted or non-substituted alkylaminosulfonyl group, a substituted or non-substituted alkoxy group, a substituted or non-substituted alkylaminocarbonyl group, a cyano group, a nitro group, or a halogen atom. $R_9$ represents a substituted or non-substituted alkyl group, a substituted or non-substituted amino group, a substituted or non-substituted alkoxy group, a substituted or non-substituted alkoxycarbonyl group, or a halogen atom; and $R_{10}$ represents a substituted or non-substituted aryl group, a substituted or non-substituted aromatic heterocyclic group, a cyano group, a nitro group, a halogen atom, or other electro-negative group. The symbol n represents an integer of 1 or 2. Preferably, each of the alkyl, cycloalkyl, aralkyl, aryl, alkoxy, acyl, acylamino, alkoxycarbonyl, alkylaminosulfonyl, alkylaminocarbonyl, and aromatic heterocyclic groups contains from 1 to 10 carbon atoms. In a particularly preferred embodiment, $R_1$ and $R_2$ each are $C_2H_5$; $R_1'$ and $R_2'$ are independently $C_2H_5$ or $C_4H_9$; $R_3$ is H or $CH_3$, preferably at the three position of the phenyl ring as indicated in formula (1); $R_4$ is H or Cl; $R_5$ is H, $CH_3$, $C_2H_5$, or $NHCOC_4H_9$; $R_6$ is $CH_3$, $C_3H_7$, preferably iso-$C_3H_7$, $OC_2H_5$, or phenyl; $R_7$ is CN; $R_8$ is $CH_3$; $R_9$ is $C_2H_5$ or $C_7H_{15}$; and $R_{10}$ is phenyl.

In another aspect, the present invention provides a method for forming an image on an image-receiving sheet using the thermal transfer sheet described above, the method comprising the steps of coupling the thermal transfer sheet described above with the image-receiving sheet, and heating a portion of the thermal transfer sheet from the back of the thermal transfer sheet to form the image corresponding to the heated portion of the thermal transfer sheet onto the image-receiving sheet.

It is to be understood that both the foregoing general description and the following detailed description are exemplary and explanatory and are intended to provide further explanation of the invention as claimed.

DETAILED DESCRIPTION OF THE PREFERRED EMBODIMENTS

A dye layer of a thermal transfer sheet according to the present invention contains at least two dyes represented by forgoing general formulae (1) and (2) above. Although any dyes represented by general formulae (1) and (2) can be used in the present invention, examples of particularly preferable dyes represented by the general formula (1) include, but are not limited to, those listed in Table 1. The dyes in Table 1 are represented according to their substituents.

TABLE 1

| Example No. | $R_1$ | $R_2$ | $R_3$ | $R_4$ | $R_5$ | $R_6$ |
|---|---|---|---|---|---|---|
| 1 | $—C_2H_5$ | $—C_2H_5$ | $CH_3$* | —Cl | $—CH_3$ | $—CH_3$ |
| 2 | $—C_2H_5$ | $—C_2H_5$ | $CH_3$* | —Cl | $—C_2H_5$ | $—OC_2H_5$ |
| 3 | $—C_2H_5$ | $—C_2H_5$ | $CH_3$* | —H | -H | Phenyl |
| 4 | $—C_2H_5$ | $—C_2H_5$ | —H | —H | $—NHCOC_4H_9$ | $—C_3H_7$(i) |

*The methyl group is located at the C3 position of the phenyl ring, as indicated in formula (1).

Examples of particularly preferable dyes represented by the general formula (2) include, but are not limited to, those listed in Table 2. The dyes in Table 2 are represented according to their substituents.

TABLE 2

| Example No. | $R_{11}$ | $R_{12}$ | $R_7$ | $R_8$ | $R_9$ | $R_{10}$ |
|---|---|---|---|---|---|---|
| 1 | $—C_2H_5$ | $—C_2H_5$ | —CN | $—CH_3$ | $—C_2H_5$ | Phenyl |
| 2 | $—C_4H_9$ | $—C_4H_9$ | —CN | $—CH_3$ | $—C_7H_{15}$ | Phenyl |
| 3 | $—C_4H_9$ | $—C_4H_9$ | —CN | $—CH_3$ | $—C_2H_5$ | Phenyl |
| 4 | $—C_2H_5$ | $—C_2H_5$ | —CN | $—CH_3$ | $—C_2H_5$ | Phenyl |

Although the proportion of the formula (1) dye to the formula (2) dye is not particularly limited, the weight ratio of dye (1) to dye (2) is preferably in the range of about 90/10 to about 10/90; more preferably in the range of about 80/20 to about 30/70. When the proportion of the dye represented by general formula (2) is too small, the efficacy of the present invention with respect to hue and saturation on the resultant image may not be fully achieved. When the proportion of the dye represented by general formula (2) is too large, the efficacy of the present invention with respect to preservative properties and heat resistance of the resultant thermal transfer sheet may be insufficient.

It may be preferable that the dye layer of a thermal transfer sheet according to the present invention contain, in addition to the dyes represented by general formulae (1) and (2), a dye represented by the following general formula (3):

(3)

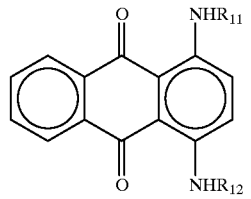

wherein $R_{11}$ and $R_{12}$ in the above formula each represent a substituted or non-substituted alkyl group, a substituted or non-substituted cycloalkyl group, a substituted or non-substituted aryl group, a substituted or non-substituted heterocyclic group, a substituted or non-substituted allyl group, or a substituted or non-substituted aralkyl group. Preferably, each of the alkyl, cycloalkyl, aryl, heterocyclic, allyl, and aralkyl groups contains from 1 to 10 carbon atoms. In a particularly preferred embodiment, $R_{11}$ is H, $CH_3$, $C_3H_7$, preferably isopropyl, 4-hydroxypropyl, or 2-(2-methoxyethoxy) ethoxyphenyl; and $R_{12}$ is $C_3H_7$, preferably isopropyl, 3-methylphenyl, 4-methylphenyl, 4-butylphenyl, 4-methoxyphenyl, 1,4-dimethylphenyl, or 4-(3-hydroxypropyl)phenyl.

The addition of such a third dye yields a further improvement in preservative effects, such as enhanced light resistance of the resultant picture image and an improved heat resistance of the thermal transfer sheet.

Examples of the preferable dye represented by general formula (3) include, but are not limited to, those listed in Table 3 below. The dyes are represented in accordance with their substituents in Table 3.

TABLE 3

| Example No. | $R_{11}$ | $R_{12}$ |
|---|---|---|
| 1 | —H | 3-methylphenyl |
| 2 | $—CH_3$ | 4-methylphenyl |
| 3 | $-C_3H_7$(i) | 4-butylphenyl |
| 4 | 2-(2-methoxyethoxy) ethoxyphenyl | 4-methoxyphenyl |
| 5 | 4-hydroxypropyl | 3-methylphenyl |
| 6 | $-C_3H_7$(i) | 4-(3-hydroxypropyl)phenyl |
| 7 | $—CH_3$ | $-C_3H_7$(i) |
| 8 | $-C_3H_7$(i) | 1,4-dimethylphenyl |

Although the amount of the formula (3) dye to be included is not particularly limited, it is preferable to be within the range of 0 to about 400 parts by weight; more preferably, about 50 to about 200 parts by weight, per 100 parts by weight of the total amount of the dyes represented by general formulae (1) and (2). Use of too large an amount of the dye represented by general formula (3) may not be preferable because the color saturation in the resulting picture image may decrease.

Any type of base sheet, including known base sheets in the art, may be used in the thermal transfer sheet according to the present invention, as long as it possesses adequate heat resistance and mechanical strength. Examples of suitable base sheets includes, but are not limited to, paper, various kinds of processed paper, polyester films, polystyrene films, polypropylene films, polysulfone films, polycarbonate films, aramid films, polyvinyl alcohol films, and cellophane. A polyester film is particularly preferred. Preferably, the base sheet has a thickness ranging from about 5 μm to about 50 μm; more preferably about 3 μm to about 10 μm.

A binder resin is provided in the dye layer on the base sheet for holding the dyes of formulae (1) and (2) and optionally the dye of formula (3). Any resin, including known resins in the art, may be used as the binder resin for holding the dye mixture, as long as it possesses adequate holding functions. Particularly preferred resins include, but are not limited to, cellulose derivatives, such as ethyl cellulose, hydroxyethyl cellulose, ethyl-hydroxy cellulose, hydroxypropyl cellulose, ethyl-hydroxyethyl cellulose, methyl cellulose, cellulose acetate, cellulose acetate butylate, cellulose acetate propionate, and cellulose nitrate; vinyl resins, such as polyvinyl alcohol, polyvinyl acetate, polyvinyl butyral, polyvinyl acetoacetal, polyvinyl pyrrolidone, polystyrene, and polyvinyl chloride; acrylic resins, such as polyacrylonitrile and polyacrylic esters; polyamide resins; polyester resins; polycarbonate resins; phenoxy resins; phenol resins; epoxy resins; and elastomers. Also, these resins may be mixed or copolymerized, or may be used by cross-linking some of the resins with various kinds of cross-linking agents. Polyvinyl butyral and polyvinyl acetal are particularly preferable in terms of their heat resistance and dye transfer capability.

The dye layer is preferably formed by the following steps. First, a coating solution (or an ink) for forming the dye layer is prepared by dissolving or dispersing the dye mixture, the binder resin, and other additives, if desired, in an appropriate solvent. Examples of the suitable solvent include, but are not limited to, methylethyl ketone and toluene. The solution is then coated on the base sheet and dried to form the dye layer. The dye layer so formed preferably has a thickness of about 0.2 μm to about 5.0 μm; more preferably about 0.4 μm to about 2.0 μm. The dye layer preferably contains about 5% to about 70% by weight, more preferably about 10% to about 60% by weight, of the dye mixture relative to the total weight of the of the dye layer.

Although the dye layer of the thermal transfer sheet according to the present invention mainly is composed of the materials described above, an organic filler, such as a polyethylene powder, or other additives known in the art may be incorporated into the layer, if desired.

While the thermal transfer sheet according to the present invention includes the dyes as specified above, other elements of the sheet may be similar to those used in thermal transfer sheets known in the art. For example, the thermal transfer sheet may be in rolled sheet form or leaflet form. It may also be a monochromatic sheet of, for example, yellow, magenta or cyan, preferably cyan, or a multi-color sheet having multiple dye layers of other hues laminated thereon, such as, for example, yellow and magenta hues.

Although the thermal transfer sheet according to the present invention produced as described above is by itself fairly useful, an adhesion prevention layer, i.e., a separating layer, may additionally be provided on the surface of the dye layer. Such a separating layer is effective in preventing the thermal transfer sheet from adhering to image-receiving sheets, thereby making it possible to use a higher thermal transfer temperature. The higher transfer temperature in turn enables a better image density in the resulting images.

Such a separating layer may be formed by merely attaching an adhesion preventing inorganic powder on the surface of the dye layer. Alternatively, a separating layer may be formed of a resin having superior separating ability, such as a silicone polymer, an acrylic polymer, and a fluorinated polymer. Preferably, the separating layer has a thickness of about 0.01 μm to about 5 μm, more preferably about 0.05 μm to about 2 μm. The inorganic powder and the separating polymer, as described here, have sufficient effects even if they are incorporated in the dye layer itself.

A heat resistant layer may also be provided on the back face of the thermal transfer sheet to prevent adverse effects that may occur due to heat from a thermal head.

Any types of picture sheet (image-receiving sheet or body) may be used for forming a picture image thereon from the thermal transfer sheet of the present invention, provided that the recording face of the image-receiving sheet has adequate dye receiving capability. Image-receiving sheets may also be produced by forming a dye receiving layer on at least one surface of paper, metal, glass, and synthetic resin, which have no dye-receiving capability.

Examples of the image-receiving sheets that do not require formation of a separate dye receiving layer include, but are not limited to, fibers, woven fabrics, films, sheets, and other cast products, which are formed of polyolefin resins, such as polypropylene; halogenated polymers, such as polyvinyl chloride and polyvinylidene chloride; vinyl polymers, such as polyvinyl acetate and polyacrylic esters; polyester resins, such as polyethylene terephthalate and polybutylene terephthalate; polystyrene resins; polyamide resins; copolymer resins of olefin, such as ethylene and propylene with other vinyl monomers; ionomers; cellulose resins, such as cellulose diacetate; polycarbonates; or the like. Particularly preferable examples of the image-receiving sheets include a sheet or film formed of polyester, or a processed paper having a polyester layer.

As stated above, a non-chromophil sheet formed of paper, metal, glass, or the like can be made to be an image-receiving sheet by coating and drying a solution or dispersion of one of chromophil resins, as recited above, on its recording surface, or by laminating such a resin layer thereon.

An image-receiving sheet with chromophil properties may be provided with an additional dye receiving layer having even better chromophil properties in a similar manner to the case of forming a dye receiving layer on paper, as described above.

These dye receiving layers may be composed of a single material or a plurality of materials. Also, various additives may be included as long as they do not impair the intended functions of the dye receiving layer.

The dye receiving layer may have an arbitrary thickness. However, the thickness is preferably within the range of about 3 μm to about 50 μm. While it is preferable that such a dye receiving layer be composed of continuous coating layers, discrete coating steps may be applied using resin emulsions or resin dispersions.

Although various types of the image-receiving sheet, as constructed above, themselves have acceptable properties for most practical use, an inorganic powder may be incorporated into the image-receiving sheet or the dye receiving layer thereof in order to further prevent undesirable adhesion to thermal transfer sheets. In this case, it is possible to prevent the thermal transfer sheet from sticking to the picture sheet even at higher thermal transfer temperatures. Thus, thermal transfer picture images with higher qualities can be obtained. A fine powder of silica is particularly preferable as the inorganic powder.

Also, a resin having superior separating ability, as described above, may be incorporated into the image-receiving sheet or the dye-receiving layer thereof instead of, or together with, the inorganic powder (a silica powder, for example). Examples of particularly preferable separating polymers include, but are not limited to, a hardened silicone compound, such as a hardened material formed of epoxy-modified silicone oil and amino-modified silicone oil. A preferable proportion of such a separating agent to the total weight of the dye receiving layer is about 0.5% to about 30% by weight.

Instead of, or in addition to, incorporation of the inorganic powder into the dye receiving layer, the inorganic powder may be merely attached to the surface of the dye receiving layer to enhance the adhesion preventive properties of the picture sheet (image-receiving sheet). Alternatively, or in addition, a layer formed of a separating agent with excellent separating capability, examples of which are described above, may be formed over the dye receiving layer. Such a separating layer produces the intended effects with a thickness of about 0.01 $\mu$m to about 5 $\mu$m, thereby preventing the thermal transfer sheet from adhering to the dye receiving layer while further improving dye receiving ability.

Any means known in the art for imparting thermal energy may be used in the thermal transfer process which uses the thermal transfer sheet of the present invention and recording media described above. A satisfactory thermal transfer can be achieved with an adequate recording device, such as a thermal printer (Video-printer VY-100, made by Hitachi Co., for example), by controlling the recording time and applying the thermal energy of about 5 mJ/mm$^2$ to about 100 mJ/mm$^2$.

WORKING EXAMPLES 1 TO 3 AND COMPARATIVE EXAMPLES 1 AND 2

The present invention will be described in more detail with reference to working examples (preferred embodiments) of the present invention and comparative examples. The units, "parts" and "percentage," in the following descriptions are in terms of weight, unless otherwise indicated.

Five types of ink preparation for forming dye layers were prepared, as shown in working examples 1 to 3 and comparative examples 1 and 2 below. Each preparation was coated and dried on a polyethylene terephthalate film with a dry coating weight of 1.0 g/m$^2$. The thickness of the polyethylene terephthalate film before coating was 6 $\mu$m, and the back surface of the film had been processed to be heat resistant. As a result, five kinds of thermal transfer sheets were obtained.

| Working Example 1 | |
|---|---|
| Dye No. 1 in Table 1 | 1.5 parts |
| Dye No. 2 in Table 2 | 1.5 parts |
| Polyvinyl acetoacetal | 3.5 parts |
| Methylethyl ketone | 46.75 parts |
| Toluene | 46.75 parts |

-continued

| Working Example 2 | |
|---|---|
| Dye No. 2 in Table 1 | 2.0 parts |
| Dye No. 2 in Table 2 | 2.0 parts |
| Polyvinyl acetoacetal | 3.5 parts |
| Methylethyl ketone | 46.25 parts |
| Toluene | 46.25 parts |
| **Working Example 3** | |
| Dye No. 1 in Table 1 | 2.0 parts |
| Dye No. 2 in Table 2 | 2.0 parts |
| Dye No. 2 in Table 3 | 2.0 parts |
| Polyvinyl acetoacetal | 3.5 parts |
| Methylethyl ketone | 46.25 parts |
| Toluene | 46.25 parts |
| **Comparative Example 1** | |
| C.I. Disperse Blue 354 | 2.0 parts |
| Dye No. 1 in Table 1 | 2.0 parts |
| Polyvinyl acetoacetal | 3.5 parts |
| Methylethyl ketone | 46.25 parts |
| Toluene | 46.25 parts |
| **Comparative Example 2** | |
| Dye No. 1 in Table 1 | 2.0 parts |
| C.I. Disperse Blue 354 | 2.0 parts |
| Dye No. 2 in Table 3 | 2.0 parts |
| Polyvinyl acetoacetal | 3.5 parts |
| Methylethyl ketone | 46.25 parts |
| Toluene | 46.25 parts |

Next, image receiving sheets were prepared as follows. A coating solution with a composition shown in Table 4 below was coated on one surface of synthetic paper sheets (Yupo EPG #150, made by Ohji Yuka Co.) so as to yield a dry weight of 10.0 g/m$^2$. The coating layer was then dried at 100° C. for 30 minutes to complete thermal transfer image receiving (picture) sheets.

TABLE 4

| | |
|---|---|
| Polyester resin (Vylon 200, by Toyobo Co.) | 11.5 parts |
| Vinyl chloride • vinyl acetate copolymer (VYHH, by UCC) | 5.0 parts |
| Amino-modified silicone (KF-393, by Shinetsu Chemical Industry Co.) | 1.2 parts |
| Epoxy-modified silicone (X-22-343, by Shinetsu Chemical Industry Co.) | 1.2 parts |
| Methylethyl ketone/toluene/cyclohexane (4:4:2 in weight ratio) | 102.0 parts |

The thermal transfer sheets of working examples 1 to 3 and of comparative examples 1 and 2 were overlaid with the thus prepared thermal transfer image receiving sheets by confronting the respective dye layers with the respective dye receiving layers. Cyan color picture images were recorded by a thermal head from the back surface of the respective thermal transfer sheets with a head applied voltage of 10 V and a printing duration of 4.0 msec.

Light resistance tests (durability tests against light irradiation) were conducted for each of the color picture images using a xenon fade-meter (CI 35A, by Atras Co.) under the conditions of a black panel temperature of 50° C., a luminous flux density of 50 kLux, and an illumination time of 50 hours to obtain luminous fading rates of the respective picture images. The optical density (OD) of each picture image before and after the light resistance test (light irradiation) was measured with a densitometer RD918 made by Macbeth Co. (USA), and the luminous fading rate was calculated from the measured optical densities by the following formula:

$$\text{Luminous fading ratio} = \left[1 - \frac{OD \text{ after light irradiation}}{OD \text{ before light irradiation}}\right] \times 100 \quad (4)$$

The results are listed in Table 5.

TABLE 5

| | Luminous fading rate |
|---|---|
| Working Example 1 | 17 |
| Working Example 2 | 14 |
| Working Example 3 | 12 |
| Comparative Example 1 | 30 |
| Comparative Example 2 | 25 |

The results in Table 5 indicate that the light resistances of the cyan color picture images obtained by the thermal transfer sheet according to the present invention are significantly improved as compared with comparative examples.

Thus, according to the present invention, thermal transfer sheets capable of forming a picture image having an excellent light resistance are realized without causing catalytic luminous fading or color changes in the images.

It will be apparent to those skilled in the art that various modifications and variations can be made in the thermal transfer sheet of the present invention without departing from the spirit or scope of the invention. Thus, it is intended that the present invention cover the modifications and variations of this invention provided they come within the scope of the appended claims and their equivalents.

What is claimed is:

1. A thermal transfer sheet comprising a base sheet and a dye layer coated on the base sheet, wherein the dye layer comprises a binder resin; at least one dye of the following formula (1); and at least one dye of the following formula (2):

(1)

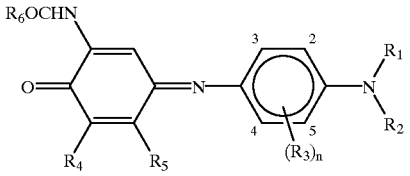

(2)

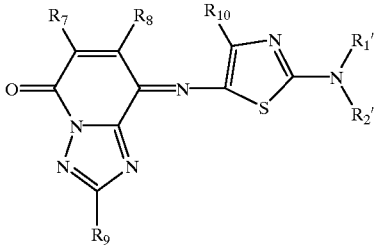

wherein $R_1$, $R_2$, $R_1'$ and $R_2'$ are independently a substituted or non-substituted alkyl group, a substituted or non-substituted cycloalkyl group, a substituted or non-substituted aralkyl group, or a substituted or non-substituted aryl group; $R_3$ is a hydrogen atom, a halogen atom, a cyano group, a hydroxyl group, a substituted or non-substituted alkyl group, a substituted or non-substituted alkoxy group, a substituted or non-substituted cycloalkyl group, a substituted or non-substituted aralkyl group, a substituted or non-substituted aryl group, a substituted or non-substituted acyl group, a substituted or non-substituted acylamino group, or a substituted or non-substituted sulfonylamino group; $R_4$ is a hydrogen atom or a halogen atom; $R_5$, is a hydrogen atom or a substituted or non-substituted alkyl group; $R_6$ is a substituted or non-substituted alkyl group, a substituted or non-substituted cycloalkyl group, a substituted or non-substituted aralkyl group, a substituted or non-substituted aryl group, or a substituted or non-substituted alkoxy group; $R_7$ and $R_8$ are independently a substituted or non-substituted alkyl group, a substituted or non-substituted cycloalkyl group, a substituted or non-substituted alkoxycarbonyl group, a substituted or non-substituted alkylaminosulfonyl group, a substituted or non-substituted alkoxy group, a substituted or non-substituted alkylaminocarbonyl group, a cyano group, a nitro group, or a halogen atom; $R_9$ is a substituted or non-substituted alkyl group, a substituted or non-substituted amino group, a substituted or non-substituted alkoxy group, a substituted or non-substituted alkoxycarbonyl group, or a halogen atom; $R_{10}$ is a substituted or non-substituted aryl group, a substituted or non-substituted aromatic heterocyclic group, a cyano group, a nitro group, a halogen atom, or any one of other electro-negative groups; and the symbol n is an integer of 1 or 2.

2. The thermal transfer sheet according to claim 1, wherein the weight ratio of said at least one dye of formula (1) to said at least one dye of formula (2) in the dye layer ranges from about 90/10 to about 10/90.

3. The thermal transfer sheet according to claim 2, wherein said weight ratio ranges from about 80/20 to about 30/70.

4. The thermal transfer sheet according to claim 1, wherein the total weight of said dyes of formulae (1) and (2) relative to the total weight of the dye layer ranges from about 5% to about 70%.

5. The thermal transfer sheet according to claim 4, wherein the total weight of said dyes of formulae (1) and (2) relative to the total weight of the dye layer ranges from about 10% to about 60%.

6. The thermal transfer sheet according to claim 1, wherein the dye layer further comprises a dye of the following formula (3):

(3)

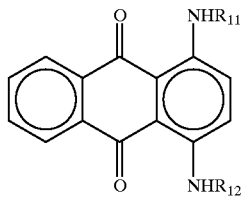

wherein $R_{11}$and $R_{12}$ are independently a substituted or non-substituted alkyl group, a substituted or non-substituted cycloalkyl group, a substituted or non-substituted aryl group, a substituted or non-substituted heterocyclic group, a substituted or non-substituted allyl group, or a substituted or non-substituted aralkyl group.

7. The thermal transfer sheet according to claim 6, wherein the proportion of said dye of formula (3) in the dye layer ranges from 0 to about 400 parts by weight per 100 parts by weight of the total amount of said two dyes of formulae (1) and (2) in the dye layer.

8. The thermal transfer sheet according to claim 7, wherein the proportion of said dye of formula (3) in the dye layer ranges from about 50 to about 200 parts by weight per 100 parts by weight of the total amount of said two dyes of formulae (1) and (2) in the dye layer.

9. The thermal transfer sheet according to claim 6, wherein the total weight of said dyes of formulae (1), (2), and (3) relative to the total weight of the dye layer ranges from about 5% to about 70%.

10. The thermal transfer sheet according to claim 9, wherein the total weight of said dyes of formulae (1), (2), and (3) relative to the total weight of the dye layer ranges from about 10% to about 60%.

11. The thermal transfer sheet according to claim 6, wherein $R_{11}$ is H, $CH_3$, isopropyl, 4-hydroxypropyl, or 2-(2-methoxyethoxy) ethoxyphenyl; and $R_{12}$ is isopropyl, 3-methylphenyl, 4-methylphenyl, 4-butylphenyl, 4-methoxyphenyl, 1,4-dimethylphenyl, or 4-(3-hydroxypropyl)phenyl.

12. The thermal transfer sheet according to claim 1, further comprising an adhesion prevention agent for preventing the thermal transfer sheet from adhering to an image-receiving sheet during thermal transfer of at least one of the dyes in the thermal transfer sheet to the image-receiving sheet.

13. The thermal transfer sheet according to claim 12, wherein the adhesion prevention agent includes at least one of an inorganic powder and an adhesion prevention layer formed of a resin.

14. The thermal transfer sheet according to claim 12, wherein the adhesion prevention agent is present on the surface of the dye layer.

15. The thermal transfer sheet according to claim 12, wherein the adhesion prevention agent is incorporated into the dye layer.

16. The thermal transfer sheet according to claim 1, wherein the base sheet is made of at least one of a polyester film, a polystyrene film, a polypropylene film, a polysulfone film, a polycarbonate film, an aramid film, a polyvinyl alcohol film, and cellophane.

17. The thermal transfer sheet according to claim 1, wherein $R_1$ and $R_2$ are each $C_2H_5$; $R_1'$ and $R_2'$ are independently $C_2H_5$ or $C_4H_9$; $R_3$ is H or $CH_3$; $R_4$ is H or Cl; $R_5$ is H, $CH_3$, $C_2H_5$, or $NHCOC_4H_9$; $R_6$ is $CH_3$, isopropyl, $OC_2H_5$, or phenyl; $R_7$ is CN; $R_8$ is $CH_3$; $R_9$ is $C_2H_5$ or $C_7H_{15}$; and $R_{10}$ is phenyl.

18. The thermal transfer sheet according to claim 1, wherein the binder resin is formed of at least one of a cellulose derivative, a vinyl resin, an acrylic resin, a polyamide resin, a polyester resin, a polycarbonate resin; a phenoxy resin; a phenol resin:, an epoxy resin; and an elastomer.

19. The thermal transfer sheet according to claim 18, wherein the vinyl resin is polyvinyl butyral, polyvinyl acetoacetal, or polyvinyl acetal.

20. The thermal transfer sheet according to claim 1, wherein the thermal transfer sheet is in the form of a leaflet or rolled sheet.

21. A method for forming an image on an image-receiving sheet using the thermal transfer sheet of claim 1, the method comprising the steps of:

coupling the thermal transfer sheet of claim 1 with the image-receiving sheet; and heating a portion of the thermal transfer sheet from the back of the thermal transfer sheet to form the image corresponding to the heated portion of the thermal transfer sheet onto the image-receiving sheet.

22. The method according to claim 21, wherein the image-receiving sheet is one of a fiber, a woven fabric, a film, and a plane sheet, and includes at least one of a polyolefin resin, a halogenated polymer, a vinyl polymer, a polyester resin, a polystyrene resin, a polyamide resin, a copolymer resin of olefin, an ionomers, a cellulose resin and a polycarbonate.

23. The method according to claim 21, wherein the image-receiving sheet includes a separating agent for preventing the image-receiving sheet from adhering to the thermal transfer sheet, the separating agent including at least one of an inorganic powder and a resin made of a hardened silicone compound.

* * * * *